United States Patent [19]

Heywood

[11] 4,262,906

[45] Apr. 21, 1981

[54] REEL SPINNING MEANS

[75] Inventor: Joseph R. Heywood, 218 Morgan St., Kingsgrove New South Wales,, Australia

[73] Assignees: Joseph Richard Heywood, Kingsgrove; Leonard Hastings Ainsworth, Rosebery, both of Australia

[21] Appl. No.: 40,308

[22] Filed: May 18, 1979

[30] Foreign Application Priority Data

Oct. 12, 1978 [AU] Australia ..... PD634078

[51] Int. Cl.[3] ..... A63F 5/04

[52] U.S. Cl. ..... 273/143 R

[58] Field of Search ..... 273/143 R, 143 A, 143 B, 273/143 C, 143 D, 143 E; 194/DIG. 11

[56] References Cited

U.S. PATENT DOCUMENTS

| | | | |
|---|---|---|---|
| 1,329,886 | 2/1920 | Catron | 273/143 R UX |
| 3,650,535 | 3/1972 | Ohki | 273/143 R |
| 3,655,199 | 4/1972 | Ohki | 273/143 R |
| 3,658,340 | 4/1972 | Ohki | 273/143 |
| 3,751,040 | 8/1973 | Carey | 273/143 R |
| 4,099,722 | 7/1978 | Rodesch | 273/143 R |

FOREIGN PATENT DOCUMENTS

| | | | |
|---|---|---|---|
| 1368622 | 10/1974 | United Kingdom | 273/143 R |

*Primary Examiner*—Richard C. Pinkham
*Assistant Examiner*—Arnold W. Kramer

[57] ABSTRACT

A reel spinning apparatus for use in devices in which a plurality of reels carrying representations of symbols, letters, numbers or other indicia on their peripheries are assembled linearly spaced alongside each other and are free to rotate independently of each other in which each reel is rotatably mounted in a bracket which is itself pivotably mounted on a base in which is an electric motor and a shaft carrying friction drive wheels one for each reel. The reels each have an annular surface and frictional driving contact with one of the friction drive wheels, the weight of the reel and its associated bracket acting to hold the annular surface in engagement with the friction drive wheel. The reels are thus all driven together but may be stopped individually by means of a solenoid operated detent which is engageable in any one of a plurality of notches or the like formed around the circumference of each reel. On stopping a reel the friction drive wheel continues to rotate but simply slips on the surface of the reel.

Alternatively the friction drive wheel can be clutch driven in such a way that the clutch will slip when the wheel is stopped.

Associated with each reel is a sensor for sensing the position in which the reel has stopped. A preferred sensor is a photo optical apparatus operating in conjunction with holes formed in the reel the position of each of which is associated with one of the indicia arranged around the circumference of the reel.

2 Claims, 5 Drawing Figures

REEL SPINNING MEANS

The present invention relates to an improved reel spinning means for use in devices in which a plurality of reels carrying representations of symbols, letters, numbers or other indicia on their peripheries are assembled linearly spaced alongside each other and are free to rotate independently of each other. Such an arrangement is useful in machines of the kind variously known as poker machines, fruit machines or slot machines and also in coin freed amusement devices, advertising devices and random or pseudo-random number generators.

It is a requirement of such apparatus that the reels shall be capable of being spun simultaneously or separately and stopped in any desired sequence. It is also required that it shall be possible to restrain one or more reels from spinning as desired. The object of the invention is to provide a reel spinning means which meets the requirements set out above in a simple and effective manner.

The invention consists in reel spinning means comprising a base, a drive shaft supported in bearings in the base, electric motor means arranged to drive said drive shaft, a plurality of friction drive wheels arranged at intervals along the length of the shaft and driven thereby, a plurality of reel carrying brackets pivotably mounted on the said base, a reel rotatably mounted on each said bracket, each reel having an annular surface in frictional driving contact with one of said friction drive wheels, the weight of each reel and its associated bracket acting to hold the said annular surface in engagement with the friction drive wheel, a plurality of notches or the like formed around the circumference of each reel or a part attached thereto, solenoid controlled detent means associated with each reel, said detent means being arranged to engage selectively in one of said notches or the like with its associated reel to cause the reel to stop and means associated with each reel for sensing the position in which the reel has stopped.

Figure 1:
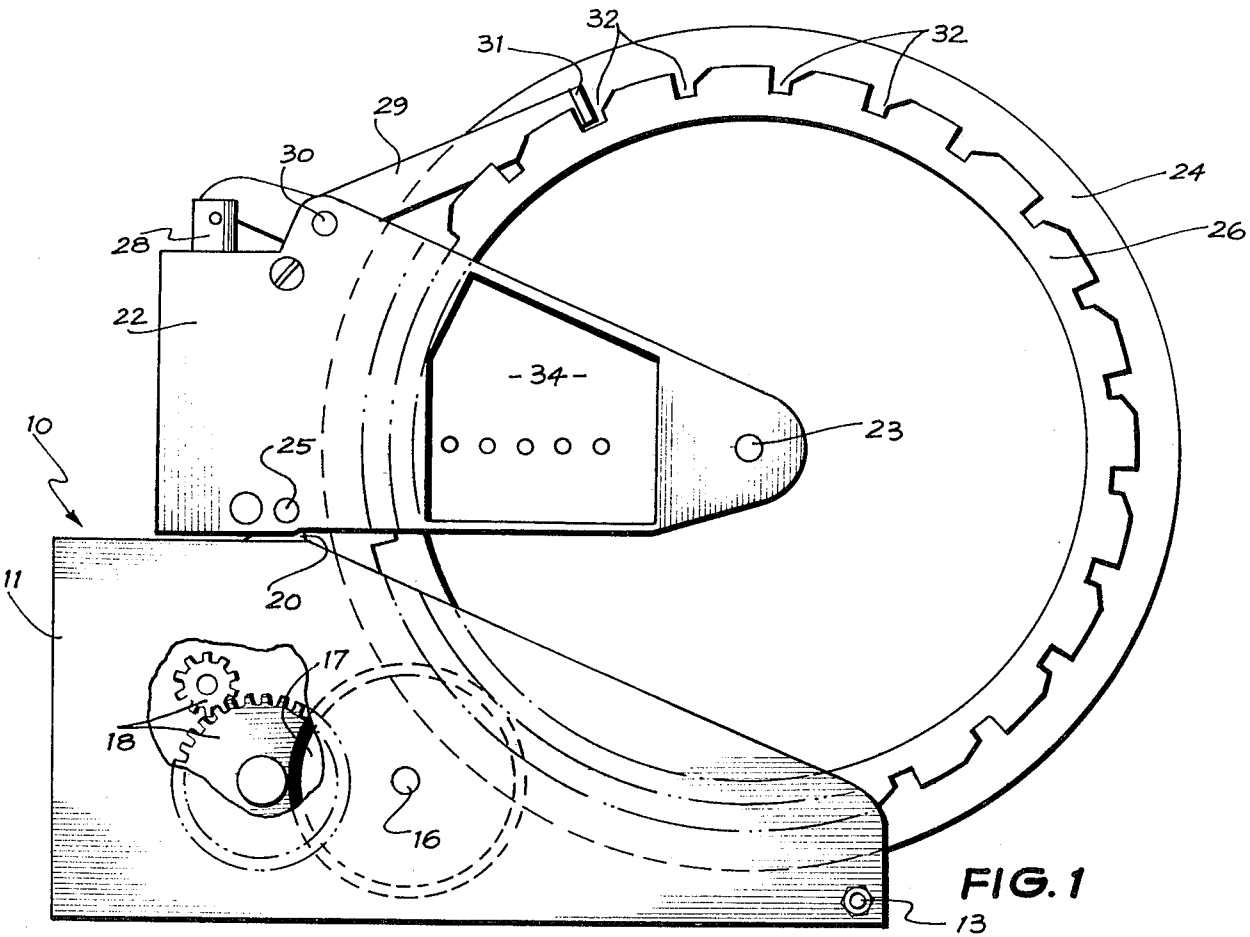
Figure 2:
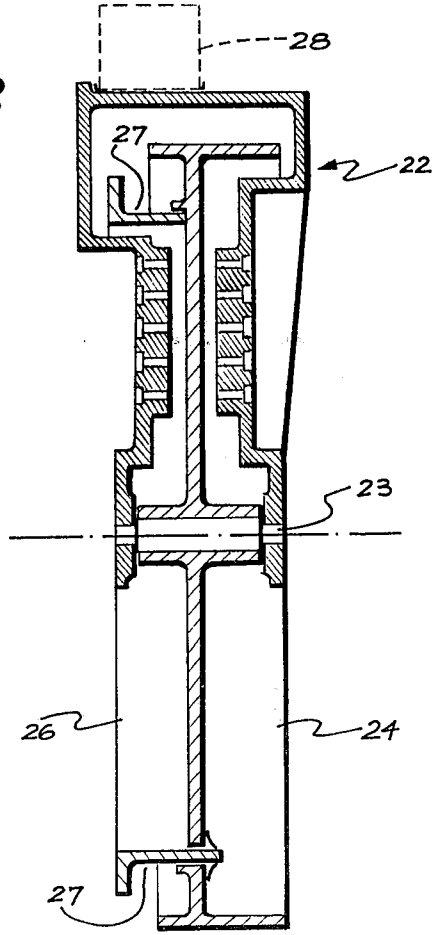
Figure 4:
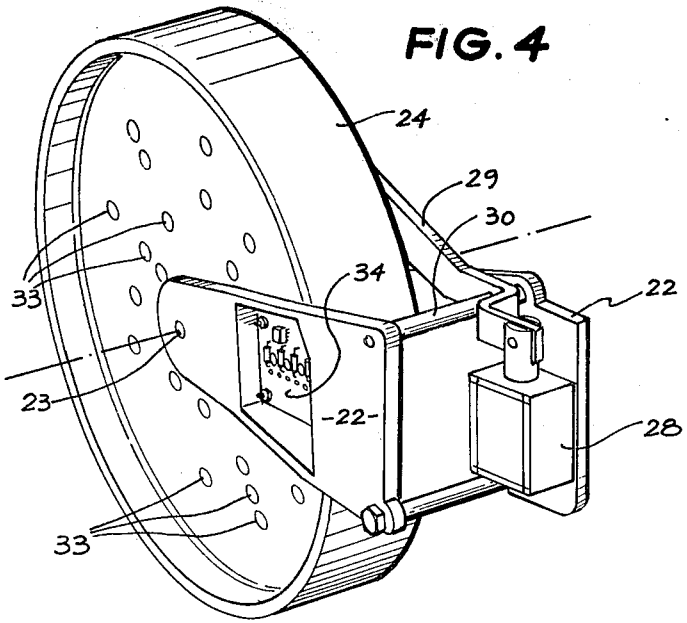
Figure 3:
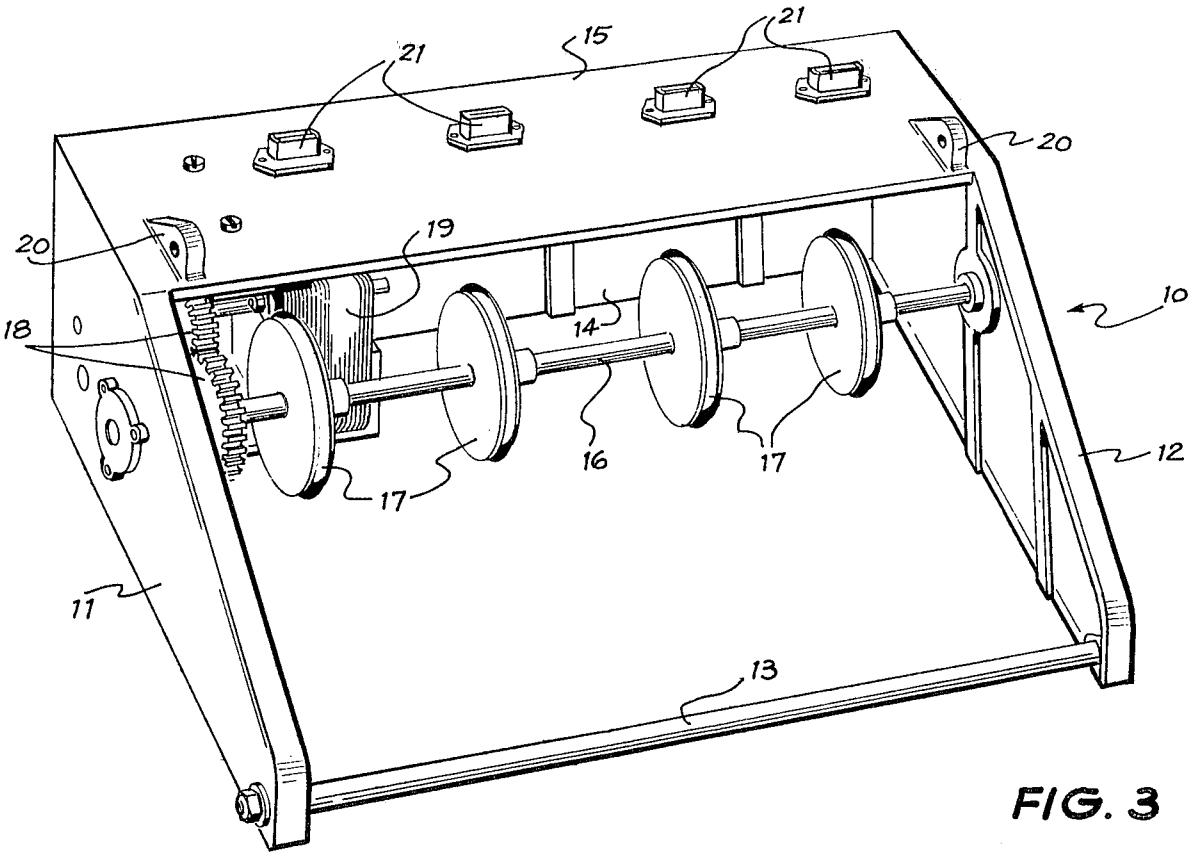
Figure 5:
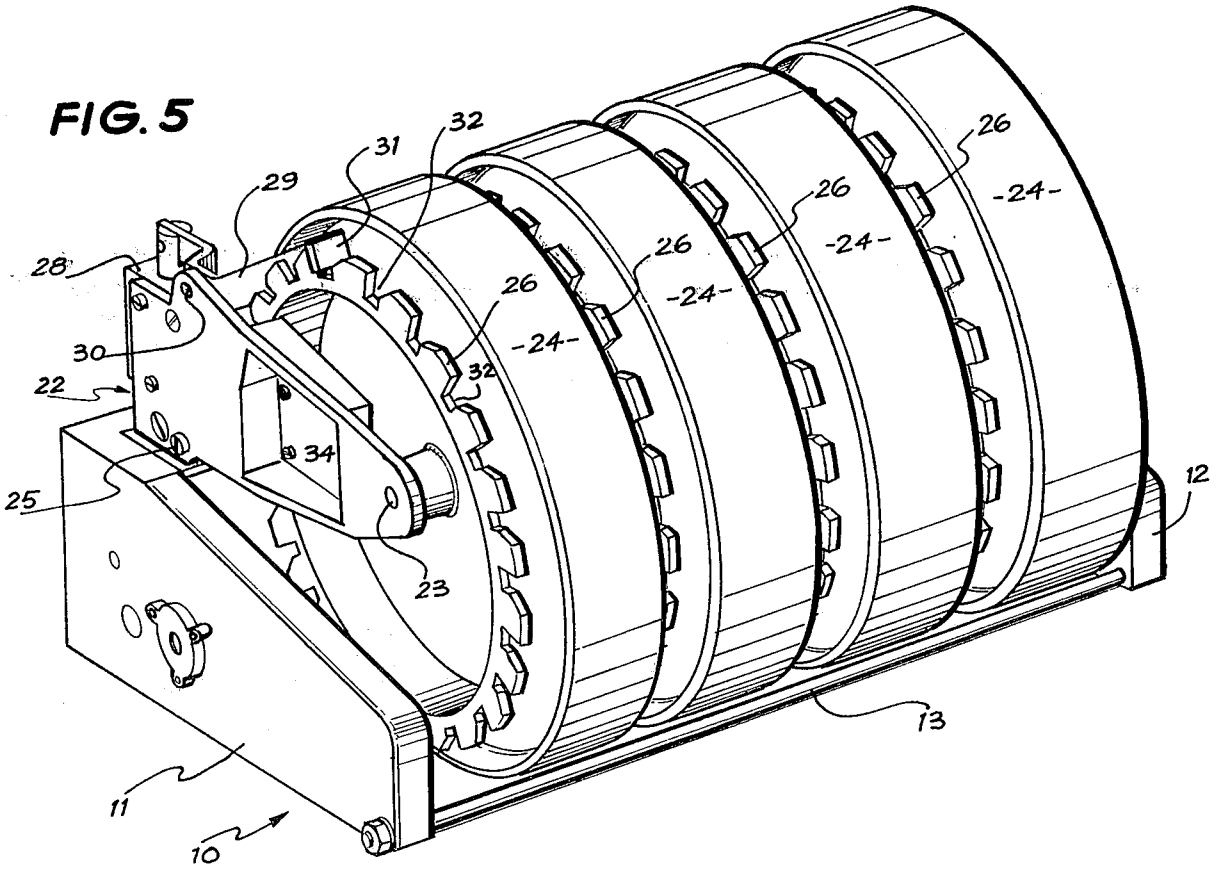

In order that the invention may be better understood and put into practice a preferred form thereof is hereinafter described, by way of example, with reference to the accompanying drawings in which:

FIG. 1 is a diagrammatic view of a side elevation of reel spinning means according to the invention, FIG. 2 is a sectional plan view of one reel assembly, showing the reel axle and its supporting bracket, FIG. 3 is a perspective view of the base assembly of the apparatus, FIG. 4 is a perspective view of one reel assembly showing the reel and its associated bracket and FIG. 5 is a perspective view of the complete apparatus.

The apparatus consists of a base 10 as seen in FIG. 3, which is preferably formed as a plastic moulding having sides 11 and 12 joined at their front ends by a spacer tube and bolt 13 and a back 14 and a top 15. Extending between the sides 11 and 12 is a driving shaft 16 having on it four friction drive wheels 17. These are formed with a circumferential groove to accommodate a rubber "O" ring. The shaft 16 is driven by the gear train 18 from the electric motor 19. On the top 15 are lugs 20 which support a pivot pin 25 acting as a pivot for the reel brackets to be described. Also on the top are four photo optic loom sockets 21 which form part of the sensing means for determining the position in which any reel stops.

Each reel assembly consists in a reel support bracket 22 which carries a reel spindle 23 on which the reel 24 is rotatably mounted. The reel brackets 22 are pivotably mounted on the reel assembly pivot brackets 20 by means of a common pivot pin 25 (FIG. 1).

Each reel 24 has attached to it or forming part of it a notched "star" wheel moulding 26 having around its circumference a plurality of notches and having an annular driving wheel track way 27 (FIG. 2) which is maintained in contact with a driving wheel 17 as shown in FIG. 1 by the weight of the assembly acting about the pin 25.

Associated with each bracket 22 is a solenoid 28 to the armature of which is attached a stopper arm 29 which is pivotably supported on a pivot pin 30 carried on the reel bracket 22. The end 31 of each stopper arm is arranged to engage in any one of the notches 32 formed around the circumference of the "star" wheel 26.

Under normal circumstances all reels are spun simultaneously and for this purpose all four solenoids 28 are energised to raise the stopper arm 29 to bring the ends 31 thereof free of the notches 32. The electric motor 19 is then caused to drive the shaft 16 and the friction drive wheels 17 which in turn drive all four reels by reason of the friction drive connection between the friction drive wheels 17 and the annular trackways 27 on the reels. The wheels are then brought to rest one at a time by deenergising the solenoid of one reel for example the reel on the left hand side of FIG. 5, thus causing the end 31 to engage in a notch 32 and stop the reel positively in a predetermined position. The stopping of one reel however does not interfere with the continued rotation of the other reels as the driving wheel in engagement with the reel that has been stopped continues to rotate but simply slips in relation to the stopped reel. The other reels may then be stopped one after the other in turn; when all reels are stopped the electric motor is switched off.

In an alternative form of construction the friction drive wheels are driven from the shaft 16 through simple spring loaded friction clutches so that when one reel is stopped the friction drive wheel in contact with it continues to turn and slippage occurs in the clutch. Such a clutch arrangement may consist of a pressure plate with a friction surface mounted on the shaft, a similar friction face on one side of the friction drive wheel, a coil spring on the shaft acting on the other side of the friction drive wheel to bring the friction faces into contact and a pressure adjustment nut bearing on the free end of the coil spring with means for adjusting the position of the nut on the drive shaft so that the pressure exerted by the spring on the friction drive wheel may be varied.

When the reels are stopped one of the symbols or indicia on the circumference of each of the reels (these are not shown in the drawings as it is not necessary for the understanding of the present invention) are visible in a viewing window and all reels together will produce a combination of indicia which can be used for a variety of purposes. In the case of a poker machine a prize is delivered when a certain combination of indicia is presented. In a random number generator machine the combination of integers making up the number will be visible but it will in most cases be desirable to be able to transfer the number generated to some other apparatus.

Normally therefore it is necessary to have a means of determining the position in which each of the reels has stopped in order, for example, to control the delivery of a prize or to transmit the random number generated to where ever it is to be used.

So far as the present invention is concerned a variety of different means of sensing the position of the reels may be used and the particular means does not form a part of the present invention. By way of example however a photo optic means is illustrated in which there are formed in each reel a plurality of holes 33 the positions of which are related to the positions of the indicia on the reel and may be detected by photo optic means 34 and this information utilised in a manner known per se. Each photo optic means is connected to a photo optic loom socket 21 in the base by means of a plug.

The invention provides a very simple and effective means for spinning the reels and for stopping them in any one of a plurality of predetermined positions. The majority of the parts of the apparatus may be formed inexpensively by moulding from plastic material.

The embodiment of the invention described above is given by way of example only as constituting a preferred form of the invention defined broadly above.

I claim:

1. Reel spinning means comprising a base, bearings in the base, a drive shaft supported in said bearings, electric motor means arranged to drive said drive shaft, a plurality of friction drive wheels arranged at intervals along the length of the shaft and driven thereby, a plurality of reel carrying brackets pivotably mounted on said base, a reel rotatably mounted on each said bracket, each reel having an annular surface in frictional driving contact with one of said friction drive wheels, the weight of each reel and its associated bracket acting to hold said annular surface in engagement with the friction drive wheel, a plurality of notches formed around the circumference of each reel or a part attached thereto, solenoid controlled detent means associated with each reel, said detent means being arranged to engage selectively in any one of said notches with its associated reel to cause the reel to stop, and means associated with each reel for sensing the position in which the reel has stopped.

2. Reel spinning means as claimed in claim 1 wherein each reel has formed in it a plurality of transverse axially divided holes the position of each of which is related to the position of one of a plurality of indicia arranged around the circumference of the reel and wherein each bracket carries photo optic means which in conjunction with said holes contribute a plurality of said position sensing means.

* * * * *